US009458791B2

(12) United States Patent
Park et al.

(10) Patent No.: US 9,458,791 B2
(45) Date of Patent: Oct. 4, 2016

(54) DEVICE FOR CORRECTING INJECTOR CHARACTERISTICS

(71) Applicants: Hyundai Motor Company, Seoul (KR); Kia Motors Corporation, Seoul (KR)

(72) Inventors: Choong Seob Park, Gyeonggi-do (KR); Ji Haeng Lee, Gyeonggi-do (KR); Kang Hee Cho, Gyeonggi-do (KR); Doo Jin Jang, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 300 days.

(21) Appl. No.: 14/340,943

(22) Filed: Jul. 25, 2014

(65) Prior Publication Data

US 2015/0275814 A1 Oct. 1, 2015

(30) Foreign Application Priority Data

Mar. 31, 2014 (KR) ..... 10-2014-0037761

(51) Int. Cl.

| | |
|---|---|
| ***F02D 41/24*** | (2006.01) |
| ***F02D 41/38*** | (2006.01) |
| ***F02M 51/00*** | (2006.01) |
| ***F02D 41/20*** | (2006.01) |
| *F02D 41/40* | (2006.01) |

(52) U.S. Cl.

CPC ..... *F02D 41/38* (2013.01); *F02D 41/20* (2013.01); *F02D 41/247* (2013.01); *F02M 51/005* (2013.01); *F02D 41/403* (2013.01); *F02D 2041/2055* (2013.01); *F02D 2041/2058* (2013.01); *F02D 2200/063* (2013.01)

(58) Field of Classification Search

CPC ..... F02D 41/2467; F02D 41/247; F02D 2200/063

See application file for complete search history.

(56) References Cited

U.S. PATENT DOCUMENTS

| | | | | |
|---|---|---|---|---|
| 8,935,114 | B2 * | 1/2015 | Beer | F02D 41/20 123/90.11 |
| 2008/0077306 | A1 | 3/2008 | Kloppenburg et al. | |
| 2013/0166482 | A1 * | 6/2013 | Veit | F02D 41/1402 706/12 |

(Continued)

FOREIGN PATENT DOCUMENTS

| | | | |
|---|---|---|---|
| JP | 2002-004921 | A | 1/2002 |
| JP | 2014-055547 | A | 3/2014 |
| KR | 10-1994-0015209 | A | 7/1994 |

(Continued)

*Primary Examiner* — Erick Solis

(74) *Attorney, Agent, or Firm* — Mintz Levin Cohn Ferris Glovsky and Popeo, P.C.; Peter F. Corless

(57) ABSTRACT

A device for correcting injector characteristics includes: an injector-characteristic detection unit that outputs a selection signal by detecting drive characteristics of injectors in response to a selection control signal; a selection control unit that outputs the selection control signal for selecting a factor for deviation correction to the injector-characteristic detection unit; a selection confirmation unit that confirms a variation value of the factor corresponding to the selection signal; a deviation correction unit that calculates a deviation compensation value corresponding to the injector characteristics in response to an output signal of the selection confirmation unit, and thus output a correction signal; a control unit that generates a correction clock in response to the correction signal; and an output drive unit that controls driving of the injectors in response to the correction clock.

14 Claims, 2 Drawing Sheets

(56) References Cited

U.S. PATENT DOCUMENTS

| | | | | |
|---|---|---|---|---|
| 2014/0283792 | A1* | 9/2014 | Benson | F02D 41/2467 123/478 |
| 2014/0311457 | A1* | 10/2014 | Christ | F02D 41/30 123/478 |
| 2015/0275809 | A1* | 10/2015 | Shibata | F02D 41/3005 701/104 |

FOREIGN PATENT DOCUMENTS

| | | | |
|---|---|---|---|
| KR | 10-2004-0018535 | A | 3/2004 |
| KR | 10-0713687 | | 4/2007 |
| KR | 10-1033062 | | 5/2011 |
| KR | 10-2013-0097078 | | 9/2013 |
| KR | 10-1341087 | | 12/2013 |
| WO | 03/014555 | A1 | 2/2003 |

* cited by examiner

DEVICE FOR CORRECTING INJECTOR CHARACTERISTICS

CROSS-REFERENCE TO RELATED APPLICATION

This application claims under 35 U.S.C. §119(a) the benefit of Korean patent application No. 10-2014-0037761 filed on Mar. 31, 2014, the disclosure of which is hereby incorporated in its entirety by reference.

BACKGROUND (a) Field of the Invention

Embodiments of the present invention relate to a motor driving device for vehicles, and more particularly to a technology for allowing a drive semiconductor to automatically select a voltage or current for checking an injector closing point of an injector for fuel injection.

(b) Description of the Related Art

Conventionally, a vehicle engine receives data from various sensors of the engine during fuel supply. An electronic control unit (ECU) mounted to vehicles decides the amount of fuel on the basis of the received data, and supplies the determined amount of fuel to the vehicles using an injector designed for fuel injection.

A fuel injector for supplying/injecting a fuel is mounted to the vehicle engine system. Specifically, an injector for directly injecting fuel into a combustion chamber is mounted to diesel engine vehicles. A common rail system serving as one example of the fuel injection device can provide fuel to a rail using a high-pressure pump. In addition, the ECU receives pressure of the rail from a pressure sensor so as to control the rail pressure, and is designed to inject fuel by transmitting a fuel injection signal.

This common rail system mounts an accelerometer to the center part of an engine block, learns a signal generated from the accelerometer every hour, and adjusts the amount of pilot fuel in response to an injector status.

Although the same injector repeatedly injects a small amount of fuel, the amount of fuel injection needs to be managed within a predetermined deviation range in such a manner that the common rail system can satisfactorily perform original functions, so as to manage the amount of fuel pilot injection or post injection.

Since the new Euro 6 (Euro 6+) emission regulations will become effective in 2017 in Europe, many automobile companies of advanced countries are conducting intensive research into new technologies capable of meeting the stringent Euro 6+ emission regulations.

In particular, the Euro 6+ emission regulations are more stringent rules regarding exhaust pollutant emissions or fine dust emissions. A core technology for reducing the amount of exhaust pollutant emissions or fine dust emissions is a multi-injection technology.

The multi-injection technology is designed to divide one fuel injection time into several fueling times so as to provide a small amount of fuel to the vehicle engine during each fueling time, instead of simultaneously providing a large amount of fuel to the vehicle engine. As a result, the multi-injection technology has advantages in that exhaust pollutant emissions or fine dust emissions can be greatly reduced.

A core technology of the multi-injection technology aims to correctly inject a smaller amount of fuel into the engine during a shorter fueling time as compared to the conventional art, so that it is necessary for the multi-injection technology to precisely control the injector designed for fuel injection.

A general injector has been designed to use only one of a voltage and a current so as to recognize the presence or absence of a deviation caused by characteristics of a plurality of injectors.

A method for determining whether a voltage or current will be selected to recognize the presence or absence of a deviation of injector characteristics has been decided in an early development stage. One factor decided in the early development stage has been continuously used to correct a deviation of injector characteristics.

However, such injectors are different in unique characteristics from each other because there are different kinds of injectors manufactured by different companies. In other words, some injectors (e.g., gasoline systems) may have a larger difference in voltage characteristics thereof, and some injectors (e.g., diesel systems) may have a larger difference in current characteristics thereof.

In addition, there is a possibility that the corresponding factors may be changed due to environmental factors, so that the conventional injector has difficulty in correctly compensating for deviation.

SUMMARY

Various embodiments of the present invention are directed to providing a device for correcting injector characteristics that substantially obviates one or more problems due to limitations and disadvantages of the related art.

An embodiment of the present invention relates to a technology for enabling a drive semiconductor to automatically select a voltage or current for checking an injector closing point when an injector is driven, such that a deviation correction action can be efficiently performed by applying the selected voltage or current to deviation correction of characteristics between a plurality of injectors.

In accordance with an aspect of the embodiment, a device for correcting injector characteristics of injectors includes: an injector configured to control a fuel injection operation; and a drive semiconductor configured to select a factor for correcting a deviation of the injector characteristics by detecting drive characteristics of the injectors, correct the deviation in response to the selected factor, and control driving of the injectors.

In accordance with another aspect of the embodiment, a device for correcting injector characteristics of injectors includes: an injector-characteristic detection unit configured to output a selection signal by detecting drive characteristics of the injectors in response to a selection control signal; a selection control unit configured to output the selection control signal for selecting a factor for deviation correction of the injector characteristics to the injector-characteristic detection unit; a selection confirmation unit configured to confirm a variation value of the factor corresponding to the selection signal; a deviation correction unit configured to calculate a deviation compensation value corresponding to the injector characteristics in response to an output signal of the selection confirmation unit, and thus output a correction signal; a control unit configured to generate a correction clock in response to the correction signal; and an output drive unit configured to control driving of the injectors in response to the correction clock.

In accordance with another aspect of the embodiment, a method for correcting characteristics of injectors includes: outputting a selection signal by detecting drive characteristics of the injectors in response to a selection control signal; outputting the selection control signal for selecting a factor for deviation correction of the injector characteristics; confirming, by a selection confirmation unit, a variation value of the factor corresponding to the selection signal; calculating a deviation compensation value corresponding to the injector characteristics in response to an output signal of the selection confirmation unit, and thus outputting a correction signal; generating, by a control unit, a correction clock in response to the correction signal; and controlling, by an output drive unit, driving of the injectors in response to the correction clock.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and advantages of the present invention will be more apparent from the following detailed description taken in conjunction with the accompanying drawings.

DETAILED DESCRIPTION OF THE EMBODIMENTS

Reference will now be made in detail to the embodiments of the present invention, examples of which are illustrated in the accompanying drawings. Wherever possible, the same reference numbers will be used throughout the drawings to refer to the same or like parts.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Figure 1:
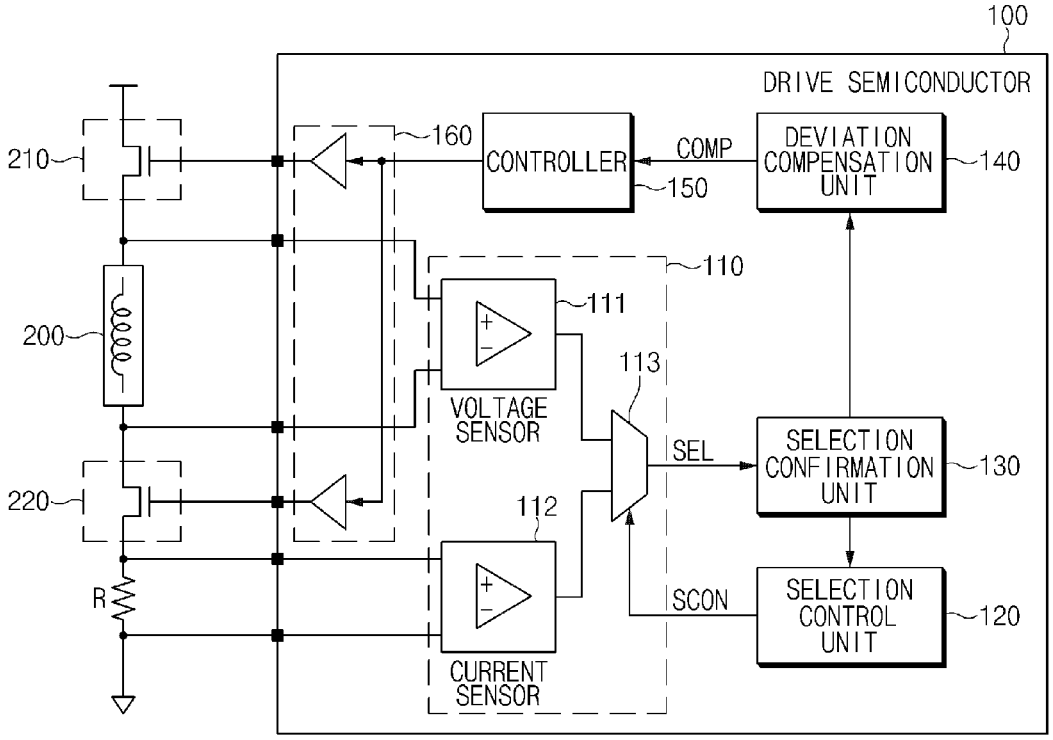
FIG. 1 is a block diagram illustrating a device for correcting injector characteristics according to an embodiment.

FIG. 1 is a block diagram illustrating a device for correcting injector characteristics according to an embodiment.

Referring to FIG. 1, the device for correcting injector characteristics includes a drive semiconductor 100 and one or more injectors 200.

The drive semiconductor 100 is configured to sense a voltage value and a current value in response to operations of each injector 200. The drive semiconductor 100 alternately decides which one of two factors (i.e., a voltage factor and a current factor) can be more effectively used as a signal for checking a deviation of characteristics between injectors 200 during an initial operation mode, and then applies the decided factor to deviation correction of characteristics between the injectors 200. In addition, the drive semiconductor 100 outputs a drive control signal for compensating for deviation of characteristics of the injectors 200.

In particular, the drive semiconductor 100 detects a signal indicating drive characteristics of the injectors 200, performs calculation processing using the detected signal, and reflects the calculation result into deviation correction of characteristics of the injectors 200. The drive semiconductor 100 detects characteristics of the injectors 200 whenever the injectors 200 are driven, and directly adjusts a closing point corresponding to a deviation of characteristics of the injectors 200 on the basis of the detected information during the next injection operation.

The injectors 200 perform fuel injection under the condition that a deviation of characteristics of the injectors 200 is compensated for in response to a drive control signal received from the drive semiconductor 100. Each injector 200 may output a signal indicating drive characteristics to the drive semiconductor 100. In this case, the signal indicating drive characteristics of the injectors 200 may be denoted by a voltage or current consumed by injection of the injectors 200.

The drive semiconductor 100 includes an injector-characteristic detection unit 110, a selection control unit 120, a selection confirmation unit 130, a deviation compensation unit 140, a control unit 150, and an output drive unit 160.

In this case, the injector-characteristic detection unit 110 may sense a drive voltage or drive current of the injectors 200, and output the sensed voltage or current to the selection confirmation unit 130. This injector-characteristic detection unit 110 includes a voltage sensor 111, a current sensor 112, and a selector 113.

The voltage sensor 111 is coupled to both nodes of each injector 200 so as to sense a voltage consumed by driving of the injector 200. The current sensor 112 is coupled to both nodes of a resistor R so as to sense a current consumed by driving of the injector 200. In this case, the resistor R is coupled to the injector 200 through the injector drive unit 220.

The selector 113 selects any one of an output signal of the voltage sensor 111 and an output signal of the current sensor 112 in response to a selection control signal SCON, and outputs the selected signal to the selection confirmation unit 130. In particular, the injector-characteristic detection unit 110 may recognize drive characteristics of the injectors 200 in response to the operations of the voltage sensor 111 and the current sensor 112.

The selection controller 120 may receive the sensed voltage or current value from the selection confirmation unit 130. The selection control unit 120 recognizes which one of voltage and current can more efficiently discriminate a deviation of characteristics of the injectors 200, such that the selection control unit 120 outputs a selection control signal SCON for selecting any one of the voltage and current to the selector 113.

In more detail, the selection control unit 120 determines which one of voltage and current can more definitely indicate some features through which the deviation of characteristics of the injectors 200 can be confirmed. The selection control unit 120 outputs the selection control signal SCON for selecting a voltage or current to check a closing point of each injector 200 to the selector 113.

The selection confirmation unit 130 may receive a selection signal SEL indicating the selected one from among the voltage and current values from the selector 113. The selection confirmation unit 130 may confirm a variation in voltage or current so as to recognize a deviation caused by characteristics of the injectors 200. The selection confirmation unit 130 may receive a current or voltage value as the selection signal SEL, determine whether the received current or voltage value is changed, and output the determined result to the deviation compensation unit 140.

The deviation compensation unit 140 converts the voltage or current value received from the selection confirmation unit 130 into a digital data value, and outputs a compensation signal COMP to the control unit 150. In particular, the deviation compensation unit 140 receives the voltage or current value from the selection confirmation unit 130, and calculates a deviation compensation value corresponding to characteristics of the injectors 200. Upon receiving the voltage or current value indicating characteristics of the injectors 200, the deviation compensation unit 140 changes the driver control signal, and performs deviation correction.

In this case, if the amount of deviation correction exceeds (e.g., is higher than) a predetermined value, the deviation compensation unit 140 determines the presence of an abnormal situation in an external load, and thus initializes the drive semiconductor 100.

The control unit 150 may receive a compensation signal COMP for controlling the closing point of each injector 200 from the deviation compensation unit 140. The control unit 150 may generate a correction clock in response to the compensation signal COMP received from the deviation compensation unit 140. In addition, the output drive unit 160 controls driving of the injector drive units (210, 220) in response to a correction clock received from the control unit 150, such that the output drive unit 160 drives the injectors 200.

Since each injector 200 has unique characteristics, there be a deviation in the closing points of a plurality of injectors according to the unique characteristics of the injectors. The corresponding deviation may affect the closing point at which each injector 200 is open and closed. Accordingly, although the injectors 200 actually operate at the same time, the individual injectors 200 may have different closing point times.

Thus, during the initial operation mode, the device according to the embodiment alternately confirms which one of voltage and current signals can be more preferably used as a signal for checking a deviation of characteristics of the injectors 200. Thereafter, the embodiment can reflect the above confirmation result into deviation compensation of characteristics of the injectors 200.

In particular, the drive semiconductor automatically selects the important factor for confirming deviation of characteristics of the injectors, and actively performs the deviation correction operation. In this case, the drive semiconductor may continuously compare characteristics of the injectors with each other not only in the early development stage but also in an operation time of each injector 200. Therefore, if deviation of characteristics of the injectors is rarely generated in a specific environment, or if the effect of each characteristic factor of the injectors is changed because the injectors are continuously used, the drive semiconductor may actively and clearly compensate for deviation of the injectors.

Figure 2:
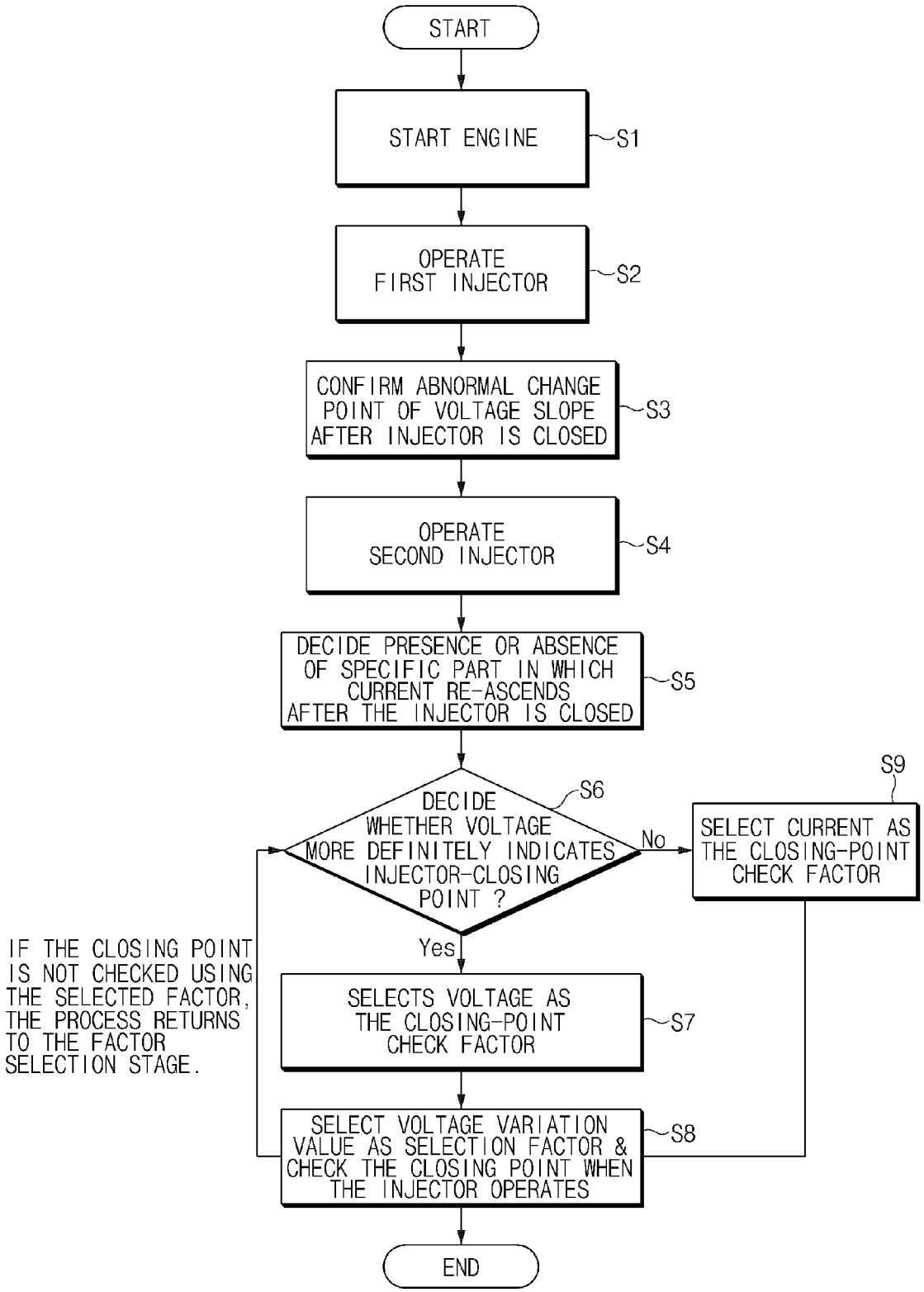
FIG. 2 is a timing diagram illustrating operations of a drive semiconductor shown in FIG. 1.

FIG. 2 is a timing diagram illustrating operations of the drive semiconductor shown in FIG. 1.

Referring to FIG. 2, if a vehicle engine starts driving in step S1, a first injector 200 operates in an early stage in step S2.

After the first injector 200 is closed, the drive semiconductor confirms an abnormal change point of a voltage slope in step S3. That is, there may be a closing point at which the injector is open and closed when the injector operates.

Accordingly, the injector characteristic detection unit 110 detects a drive voltage of the injector using the voltage sensor 111 when the injector operates, and detects a voltage generated at both ends of the injector. The selection confirmation unit 130 senses an abnormal change point of a voltage slope after the first injector is closed, and stores information regarding the abnormal change point. The sensing information confirmed by the selection confirmation unit is output to the selection control unit 120.

A solenoid valve charges a coil with electric charges so as to operate a valve. During the closing operation, charges stored in the coil exits to the outside. As a result, a voltage generated at both ends of the injector 200 is inverted in a reverse direction (i.e., a negative(−) voltage), and is then converged into 0 volt (0V).

In this case, when the injector 200 is closed, the voltage is not converged into 0V, and there may arise a voltage bounding part in which the voltage is abruptly bouncing before reaching 0V. That the selection confirmation unit 130 detects the presence or absence of a specific part in which a voltage slope variation changes from a positive(+) value to either zero (0) or a negative(−) value.

In particular, the selection confirmation unit 130 determines the specific point at which the voltage slope variation changes from a positive(+) value to either zero (0) or a negative (−) value, to be a closing point. However, the scope or spirit of the present invention is not limited thereto, and the closing point at which the presence or absence of a voltage slope variation is checked can be sufficiently changed according to injector categories.

Thereafter, a second injector 200 operates in step S4. The drive semiconductor determines the presence or absence of a specific part in which a current value re-ascends after the injector 200 is closed in step S5.

After the injector 200 is closed and a current value reaches zero ampere (0A), there may arise a part in which a current value re-ascends at the next closing point. In this case, the selection confirmation unit 130 may determine a peak part in which a current value increases from 0V to be a closing point.

The selection confirmation unit 130 may determine a specific part in which a current value starts from 0A and then increases up to a peak value after lapse of a predetermined time, to be a closing point. However, the scope or spirit of the present invention is not limited thereto, and the closing point at which the presence or absence of a peak value variation of a current is checked can be sufficiently changed according to injector categories.

In particular, the injector characteristic detection unit 110 senses a drive current of the injector 200 using the current sensor 112 after the injector 200 is closed, and determines whether the drive current is re-increased. The sensing information confirmed by the selection confirmation unit 130 is output to the selection control unit 120.

The selection control unit 120 compares the sensing information received from the selection confirmation unit 130 with predetermined information, and determines whether a voltage value can more definitely indicate the closing point of the injector 200 in step S6.

In this case, predetermined information regarding a reference injector may be pre-stored in a memory unit contained in the selection control unit 120. That is, the selection control unit 120 may determine which one of voltage and current sensed by the injector 200 can be more effectively used as a signal for correcting a deviation of characteristics of the injector 200.

Since there are different kinds of injectors manufactured by different companies, the injectors have different unique characteristics. In other words, a certain injector (e.g., a gasoline system) has a higher difference in characteristics in terms of voltage, and a certain injector (e.g., a diesel system) has a high difference in characteristics in terms of current.

As a result, the gasoline-based injector according to the embodiment may select a voltage value as a closing-point check factor for correcting a deviation of characteristics, and the diesel-based injector may select a current value as a closing-point check factor for correcting a deviation of characteristics.

However, the scope or spirit of the present invention is not limited, the gasoline-based injector may select a current value as a closing-point check factor for correcting a deviation of characteristics, and the diesel-based injector may select a voltage value as a closing-point check factor for correcting a deviation of characteristics.

If it is confirmed that the voltage can more definitely indicate the closing point of the injector 200, the selection control unit 120 selects the voltage value as the closing-point check factor, and outputs the selection control signal SCON to the selector 113 in step S7. The selector 113 may select a voltage value of the voltage sensor 111 in response to the selection control signal SCON, and output the voltage value to the selection confirmation unit 130.

The selection confirmation unit 130 detects a voltage variation value, and outputs the voltage variation value to the deviation compensation unit 140. That is, the selection confirmation unit 130 may select a voltage variation value as a selection factor, and then check the closing point when the injector 200 operates in step S8. If the closing point is not checked at the selected factor, the selection confirmation unit 130 returns to the above factor selection process, such that the closing-point check factor is re-confirmed.

On the other hand, if it is determined that the voltage is unable to more clearly indicate the closing point of the injector 200 in step S6, the selection control unit 120 selects a current as the closing-point confirmation factor in step S9.

Accordingly, the selection control unit 120 outputs the selection control signal SCON for selecting the current to the selector 113. The selector 113 selects a current value of the current sensor 112 in response to the selection control signal SCON, and outputs the selected current value to the selection confirmation unit 130.

The selection confirmation unit 130 detects a current variation value, and outputs the current variation value to the deviation compensation unit 140. That is, the selection confirmation unit 130 uses a variation in a current value as a selection factor. Thereafter, if the injector 200 starts operation, the selection confirmation unit 130 may check the closing point in step S8. If the closing point is not checked using the selected factor, the selection confirmation unit 130 returns to the factor selection operation in step S6, and re-confirms the factor for checking the closing point.

Thereafter, the deviation compensation unit 140 performs deviation compensation for each characteristic of the injector 200 on the basis of the sensing information received from the selection confirmation unit 130, and outputs the compensation signal COMP to the control unit 150.

Subsequently, the control unit 150 generates a correction clock upon receiving the compensation signal COMP from the deviation compensation unit 140. The output drive unit 160 controls driving of the injector drive units (210, 220) upon receiving a correction clock from the control unit 150, and drives the injector 200.

That is, since the drive semiconductor 100 of the embodiment corrects deviation for each characteristic of the injector 200, such that the drive semiconductor 100 can rapidly reflect the corrected resultant value.

For example, if deviation of characteristics of the injectors 200 is corrected in response to a voltage value, the compensation value is reflected into a control pulse of the injectors 200, so that an activation time point of the injection drive pulse is adjusted or coordinated. On the other hand, if deviation of characteristics of the injectors 200 is corrected in response to a current value, the compensation value is reflected into a control pulse of the injectors 200, so that an activation time point of the injector drive pulse is adjusted or coordinated.

Each injector 200 for use in the engine is generally composed of a solenoid valve, so that the injectors 200 may be open or closed in response to a power supply status. However, although the quality of the injectors 200 is well managed, there is a little deviation in electric characteristics of the injectors 200. This deviation may affect a total quantity of flow even when the injectors 200 are open during the same time.

Accordingly, if the closing point of each injector 200 is recognized, it is determined whether this injector 200 is opened for a longer or shorter time than a reference injector from among a plurality of injectors, so that a deviation of injector characteristics can be confirmed.

As a result, an injector-open time of a certain injector that is open for a longer time than the reference injector is slightly reduced, and an injector-open time of a certain injector that is open for a shorter time than the reference injector is slightly increased, so that a fuel injection operation can be correctly carried out.

As is apparent from the above description, the device for correcting injector characteristics according to the embodiment has the following effects.

First, a drive semiconductor is configured to automatically select important factors that check a deviation of characteristics between injectors, such that the drive semiconductor can actively compensate for the deviation of injector characteristics.

Second, the device of the embodiments can more efficiently estimate characteristics of injectors than the conventional art for estimating a deviation of injector characteristics by sensing only one of voltage and current.

Third, the drive semiconductor has a function to select a signal factor needed for recognizing injector closing characteristics, such that this function can be easily applied to a variety of injectors.

Fourth, the device according to the embodiments can continuously and alternately check a voltage and current during the injector operation time, such that the device can efficiently confirm injector characteristics.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for correcting injector characteristics of injectors, comprising:

an injector configured to control a fuel injection operation; and a drive semiconductor configured to select a factor for correcting a deviation of the injector characteristics by detecting drive characteristics of the injectors, correct the deviation in response to the selected factor, and control driving of the injectors.

2. The device according to claim 1, wherein the drive semiconductor includes:

an injector-characteristic detection unit configured to output a selection signal by detecting the drive characteristics of the injectors in response to a selection control signal;

a selection control unit configured to output the selection control signal for selecting the factor for deviation correction of the injector characteristics to the injector-characteristic detection unit;

a selection confirmation unit configured to confirm a variation value of the factor corresponding to the selection signal;

a deviation correction unit configured to calculate a deviation compensation value corresponding to the injector characteristics in response to an output signal of the selection confirmation unit, and thus output a correction signal;

a control unit configured to generate a correction clock in response to the correction signal; and an output drive unit configured to control driving of the injectors in response to the correction clock.

3. The device according to claim 2, wherein the injector-characteristic detection unit includes:

a voltage sensor configured to sense a drive voltage of each injector;

a current sensor configured to sense a drive current of the injector; and a selector configured to select any one of an output signal of the voltage sensor and an output signal of the current sensor in response to the selection control signal.

4. The device according to claim 2, wherein the selection confirmation unit is configured to check a closing point of the injectors by detecting a variation in voltage or current corresponding to operations of the injectors.

5. The device according to claim 4, wherein:

the selection confirmation unit checks a variation in voltage slope when a first injector is closed in operation, and thus confirms a closing point of the first injector; and the selection confirmation unit checks a variation in current slope when a second injector is closed in operation, and thus confirms a closing point of the second injector.

6. The device according to claim 4, wherein the selection control unit outputs the selection control signal, that selects any one of the voltage and current as the factor in response to an output signal of the selection confirmation unit, to the injector-characteristic detection unit.

7. The device according to claim 4, wherein the selection control unit compares sensing information received from the selection confirmation unit with predetermined injector information so as to select any one of the voltage and current according to the result of comparison.

8. A device for correcting injector characteristics of injectors, comprising:

an injector-characteristic detection unit configured to output a selection signal by detecting drive characteristics of the injectors in response to a selection control signal;

a selection control unit configured to output the selection control signal for selecting a factor for deviation correction of the injector characteristics to the injector-characteristic detection unit;

a selection confirmation unit configured to confirm a variation value of the factor corresponding to the selection signal;

a deviation correction unit configured to calculate a deviation compensation value corresponding to the injector characteristics in response to an output signal of the selection confirmation unit, and thus output a correction signal;

a control unit configured to generate a correction clock in response to the correction signal; and an output drive unit configured to control driving of the injectors in response to the correction clock.

9. The device according to claim 8, wherein the injector-characteristic detection unit includes:

a voltage sensor configured to sense a drive voltage of each injector;

a current sensor configured to sense a drive current of the injector; and a selector configured to select any one of an output signal of the voltage sensor and an output signal of the current sensor in response to the selection control signal.

10. The device according to claim 8, wherein the selection confirmation unit is configured to check a closing point of the injectors by detecting a variation in voltage or current corresponding to operations of the injectors.

11. The device according to claim 10, wherein:

the selection confirmation unit checks a variation in voltage slope when a first injector is closed in operation, and thus confirms a closing point of the first injector; and the selection confirmation unit checks a variation in current slope when a second injector is closed in operation, and thus confirms a closing point of the second injector.

12. The device according to claim 10, wherein the selection control unit outputs the selection control signal, that selects any one of the voltage and current as the factor in response to an output signal of the selection confirmation unit, to the injector-characteristic detection unit.

13. The device according to claim 10, wherein the selection control unit compares sensing information received from the selection confirmation unit with predetermined injector information so as to select any one of the voltage and current according to the result of comparison.

14. A method for correcting injector characteristics of injectors, comprising:

outputting a selection signal by detecting drive characteristics of the injectors in response to a selection control signal;

outputting the selection control signal for selecting a factor for deviation correction of the injector characteristics;

confirming, by a selection confirmation unit, a variation value of the factor corresponding to the selection signal;

calculating a deviation compensation value corresponding to the injector characteristics in response to an output signal of the selection confirmation unit, and thus outputting a correction signal;

generating, by a control unit, a correction clock in response to the correction signal; and controlling, by an output drive unit, driving of the injectors in response to the correction clock.

* * * * *